US007243832B2

(12) United States Patent
Jiang

(10) Patent No.: US 7,243,832 B2
(45) Date of Patent: Jul. 17, 2007

(54) SPRING-POWERED STAPLER

(76) Inventor: Peigen Jiang, 19480 SE. 28th Pl., Sammamish, WA (US) 98075

( * ) Notice: Subject to any disclaimer, the term of this patent is extended or adjusted under 35 U.S.C. 154(b) by 77 days.

(21) Appl. No.: 11/192,793

(22) Filed: Jul. 30, 2005

(65) Prior Publication Data

US 2007/0034664 A1 Feb. 15, 2007

(51) Int. Cl.
*B25C 5/00* (2006.01)
*B25C 5/11* (2006.01)
*B25C 1/16* (2006.01)

(52) U.S. Cl. ..... 227/120; 227/132; 227/134; 227/156

(58) Field of Classification Search ..... 227/8, 227/120, 132, 134, 156
See application file for complete search history.

(56) References Cited

U.S. PATENT DOCUMENTS 2,326,540 A 8/1943 Krantz
2,671,215 A 3/1954 Abrams
2,769,174 A 11/1956 Libert
3,862,712 A 1/1975 LaPointe et al.
3,948,426 A * 4/1976 La Pointe ..... 227/8
4,119,258 A 10/1978 Ewig, Jr.
4,184,620 A * 1/1980 Ewig ..... 227/8
5,356,063 A * 10/1994 Perez ..... 227/132
5,702,046 A * 12/1997 Rokita et al. ..... 227/110
5,765,742 A 6/1998 Marks
5,988,478 A 11/1999 Marks
6,918,525 B2 7/2005 Marks
2006/0186169 A1 * 8/2006 Marks ..... 227/120

* cited by examiner

*Primary Examiner*—Rinaldi I. Rada
*Assistant Examiner*—Nathaniel Chukwurah

(57) ABSTRACT

A hand operated stapling tool, which uses the energy stored in a spring to install staples by an impact blow, is disclosed. A housing body is preferably cast or molded. A handle is pivotally attached to the rear end of the housing body, pressing down the handle stores energy in a power spring by bending the middle section of the power spring, and further pressing down the handle unlocks the front end of the power spring which forces a driving blade to move downward and expels a staple out of the bottom of the housing body. A staple feeding track is formed at the bottom of the housing body, and the stored staples are secured by a rear-hinged panel.

9 Claims, 7 Drawing Sheets

SPRING-POWERED STAPLER

CROSS-REFERENCES

U.S. Patent Documents

| | | | |
|---|---|---|---|
| 2,326,540 | 8/1943 | Krantz | 1/49 |
| 2,671,215 | 3/1954 | Abrams | 1/49 |
| 2,769,174 | 11/1956 | Libert | 1/49 |
| 3,862,712 | 1/1975 | LaPointe et al. | 227/127 |
| 4,119,258 | 10/1978 | Ewig, Jr | 227/132 |
| 5,765,742 | 6/1998 | Marks | 227/132 |
| 5,988,478 | 11/1999 | Marks | 227/132 |
| 6,918,525 | 7/2005 | Marks | 227/120 |

BACKGROUND OF THE INVENTION

1. Field of the Invention

The present invention generally relates to hand-operated fastener applying devices and specifically to spring-powered staplers.

2. Description of the Related Art

Various spring-powered staplers employs basically the same operating principle that is to use a spring to store energy, which is then released to drive a blade to expel a staple out of the bottom of the stapler. The stapler of the present invention also uses this operating principle, but makes the structure more simplified, compact and flexible.

U.S. Pat. No. 2,326,540 issued to Krantz discloses a staple gun in which a hand lever is pivoted at the back and an actuating lever engages a vertically positioned spring and driving assembly, hence Krantz's staple gun is quite bulky.

U.S. Pat. No. 2,671,215 issued to Abrams discloses a staple gun with similar vertically placed spring and driving assembly, but a different actuating means.

U.S. Pat. No. 2,769,174 issued to Libert discloses a staple gun in which an actuating means employs two linked levers and spring and driving member assembly vertically positioned.

U.S. Pat. No. 3,862,712 issued to LaPointe et al. discloses a staple gun with a staple feeding track that slides rearward to expose a staple loading chamber. A releasable latch assembly retains the track in position.

U.S. Pat. No. 4,119,258 issued to Ewig, Jr. discloses a staple gun with a body and hand lever constructed substantially of plastic material. Its hand lever is pivoted in the front and its spring and driving assembly is vertically positioned.

U.S. Pat. No. 5,988,478 issued to Marks discloses a stapling machine in which an actuating level is used to store energy in the power spring and then released it to force a plunger to move downward and expel a staple from the bottom of the stapling machine. In order to accommodate the actuating lever, the hand-operated stapling machine is less compact.

U.S. Pat. No. 6,918,525 issued to Marks discloses a desktop stapler in which a spring lifting level is also used to activate the stapler, hence it is less compact.

SUMMARY OF THE INVENTION

In the preferred embodiment, a housing body is preferably cast or molded, which houses a driving blade, a power spring with which the driving blade is engaged, a lock assembly, and a return spring. The movement of the driving blade is contained in a vertical channel formed in a front of the housing body. A handle is pivotally attached to a rear end of the housing body with a rod touches the middle section of the power spring. With the rear end of the power spring being supported by the housing body, and the front end of the power spring being locked with the driving blade by the lock assembly in the upper position, when pressing down the handle, its rod forces the middle section of the power spring to bend and store energy. Further pressing down the handle causes the lock assembly to unlock the driving blade. Then the biased power spring releases its energy in a downward blow along with the driving blade which expels a staple at the front end of the staple feeding track.

The return spring is mounted underneath the power spring in a location vertically aligned to the handle rod. When hand pressing force is removed, the return spring resets the power spring along with the driving blade back up to their locked positions.

A staple feeding track is formed at the bottom of the housing body, with a rear-hinged panel snaps to the side walls of the feeding track to prevent staples from falling off the feeding track during operation, and a spring biased pusher to secure the staple(s) to the front of the feeding track.

This compact front end gripped and front end staple exiting design of the preferred embodiment can provides the advantage of a staple applying action similar to that of a hand-pressed desktop stapler, yet simple enough to be manufactured in comparable sizes and costs. Besides, without the constraints of an lifting lever, the stapler of present invention has further advantages of scalability in size, and flexibility in exterior designs.

DETAILED DESCRIPTION OF THE INVENTION

In the following description, numerous details such as specific materials and configurations are set forth in order to provide a more complete understanding of the present invention. However, it is understood by those skilled in the art that the present invention can be practiced without those specific details. In other instances, well-know elements are not described explicitly so as not obscure the present invention.

Figure 1:
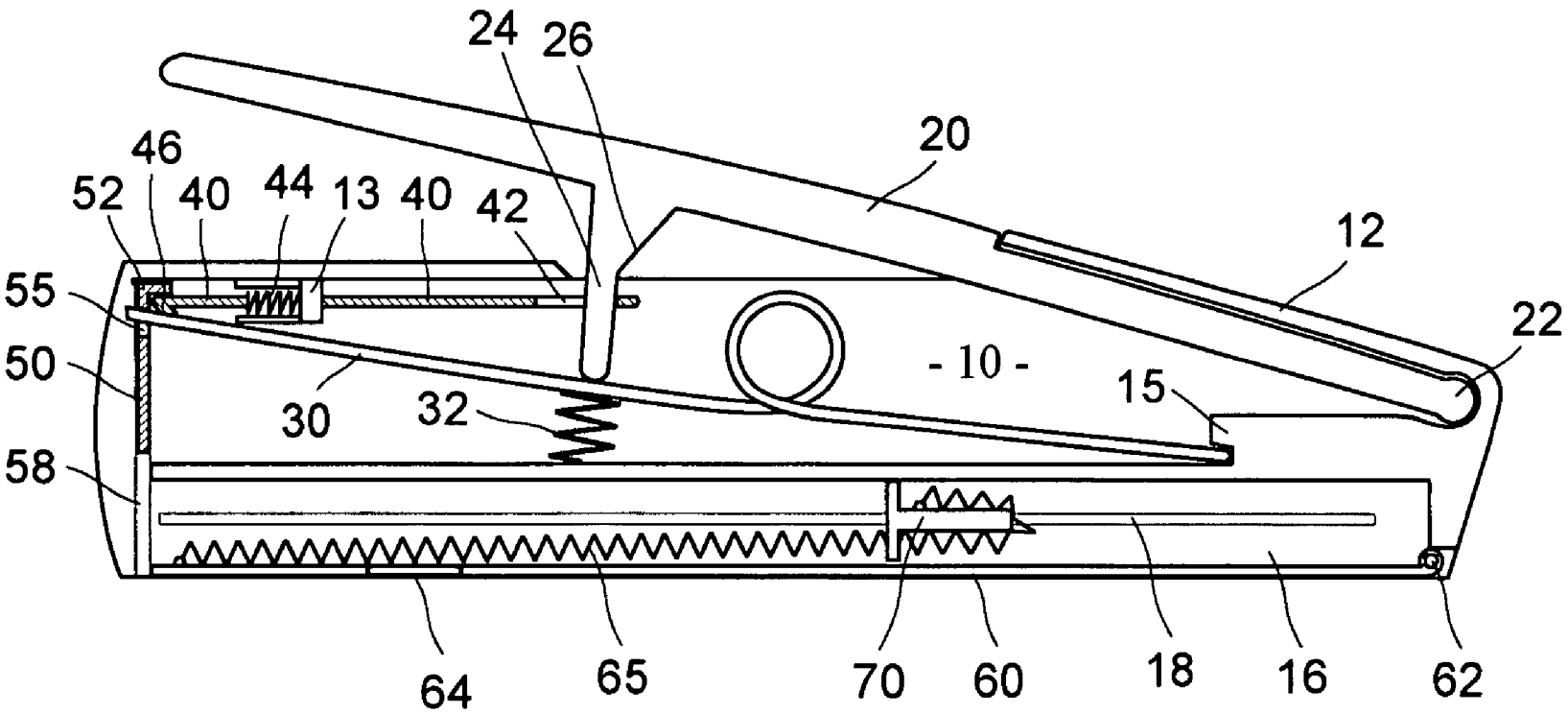
FIG. 1 is a side elevational view of preferred embodiment stapler, shown in a partial sectional view, of the present invention in a resting position.
Figure 2:
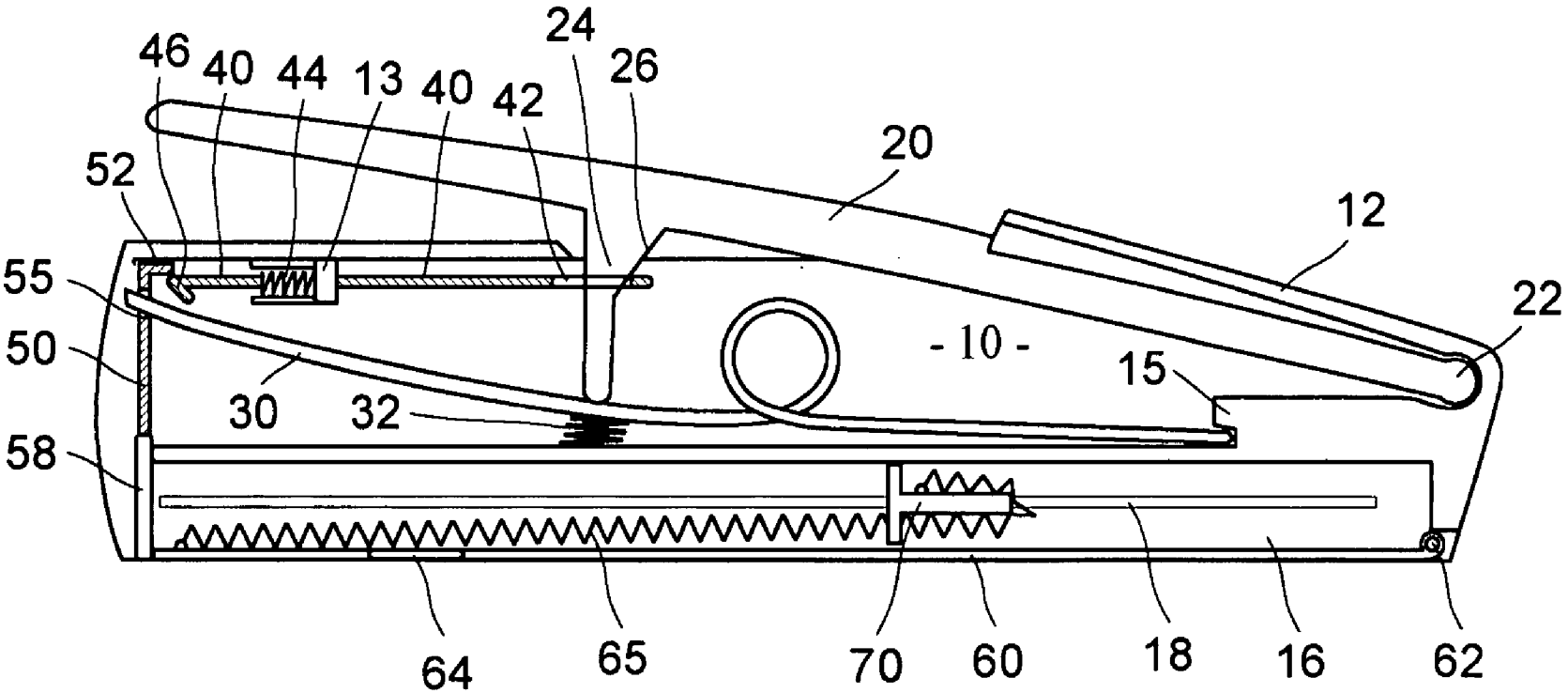
FIG. 2 is a side elevational view of the stapler of FIG. 1, just prior to ejection of a staple.

FIG. 1 shows a housing body 10 with one half removed to expose the internal essential components of the present invention.

Figure 3C:
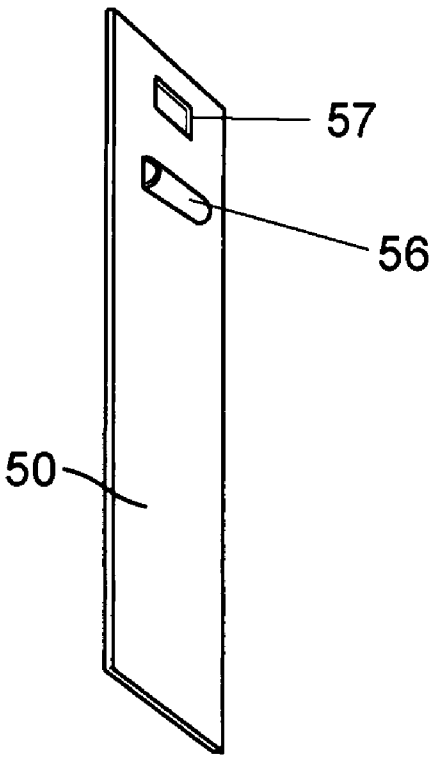
FIG. 3C is a perspective view of the driving blade with a projective horizontally placed column for linking with the power spring, and an opening for engaging locking tongue.

A driving blade 50 is contained and slidable within a vertical channel 58. In order to be locked at the top position, the driving blade 50 has a projective member 52 on the top as shown in FIG. 3A. The projective member 52 forms preferably a right angle to the vertical portion of the driving blade 50, but can be of any angle approximately from 45 degree to 135 degree as long as the driving blade 50 can engage and disengage a lock assembly.

Figure 4A:
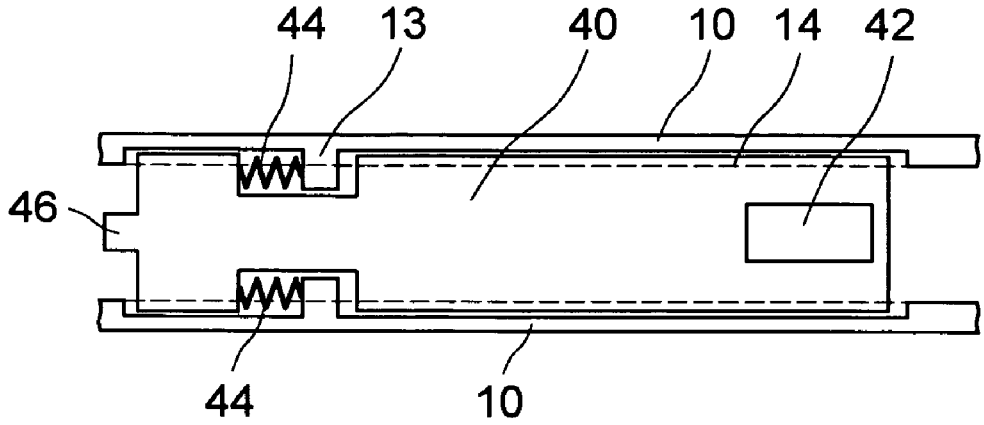
FIG. 4A is a top plan view of the lock assembly including a lock shaft with a locking tongue in the front, biasing springs on both sides and an opening on the lock shaft for handle rod to go through the lock shaft and for unlocking the driving blade with a rearward facing wedge-like surface.
Figure 4B:
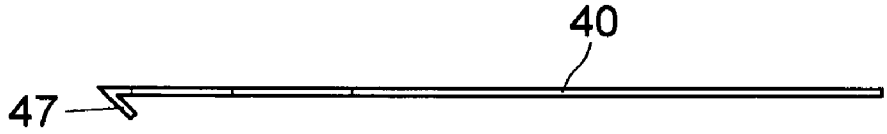
FIG. 4B is a side view of the lock assembly of FIG. 4A, showing a bottom tapered front end of the locking tongue to enable the driving blade to be pushed up and to engage the locking tongue.

Refer to FIG. 4A and FIG. 4B, the lock assembly includes a spring biased, slidable lock shaft 40, with a locking tongue 46 in the front. The slidable lock shaft 40 is contained in a substantially horizontal channel 14 formed on the side walls of the housing body 10. Springs 44 mounted against a stopper 13 of the housing body 10, bias the lock shaft 40 forward, so that the locking tongue 46 stays beneath the project member 52 of the driving blade, and stops the driving blade 50 from being forced down by a power spring 30.

Figure 3B:
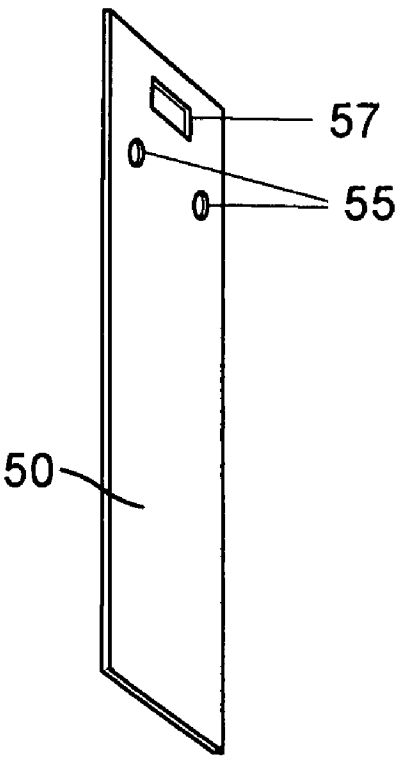
FIG. 3B is a perspective view of the driving blade with two openings for linking with the power spring and an opening for engaging locking tongue.
Figure 3A:
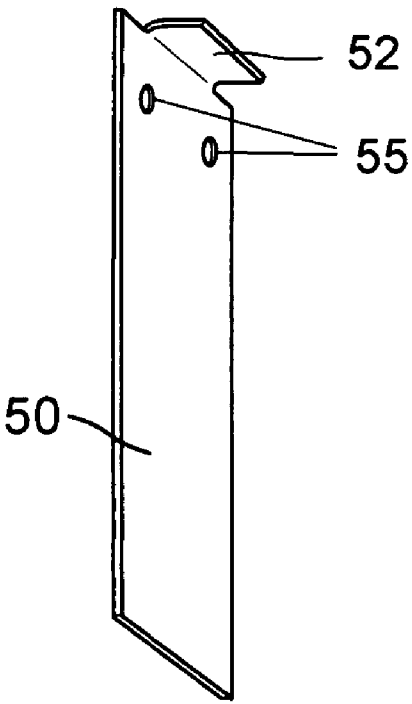
FIG. 3A is a perspective view of the driving blade with two openings for linking with the power spring and a project member on top to engage the locking tongue.

In another embodiment, there is an opening 57 near the top of driving blade as shown in FIG. 3B, so that locking tongue 46 can be inserted into the opening 57 for locking the driving blade 50.

The vertical portion of the driving blade 50 is a thin sheet metal form that is substantially flat except for small out-of-plane features, which may be incorporated as a design choice. A completely flat portion of the driving blade 50 may also be used. The thickness of the sheet metal used to make the driving blade is less than the thickness of a standard staple.

In order to link the driving blade 50 with the power spring 30, in one embodiment, there is at least one opening on the flat portion of the driving blade 50 as shown in FIG. 3A and FIG. 3B, so that a front end of the power spring 30 can be inserted into the opening. In another embodiment, there is at least one projective column 56 for the power spring 30 to be hinged on as shown in FIG. 3C.

Figure 5A:
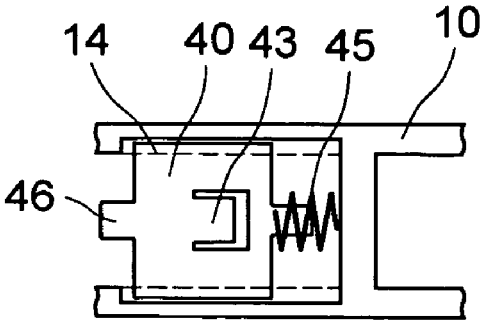
FIG. 5A is a top plan view of the lock assembly including a lock shaft with a locking tongue in the front, a biasing spring at the back and a wedge with a slanted surface on its front side for the lock shaft being pushed backward by a second rod on the handle.
Figure 5B:
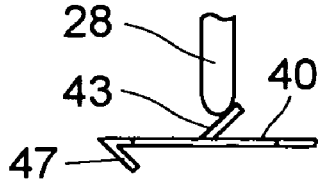
FIG. 5B is a side view of the lock assembly of FIG. 5A, showing a bottom tapered front end of the locking tongue to enable the driving blade to be pushed up and to engage the locking tongue.
Figure 6:
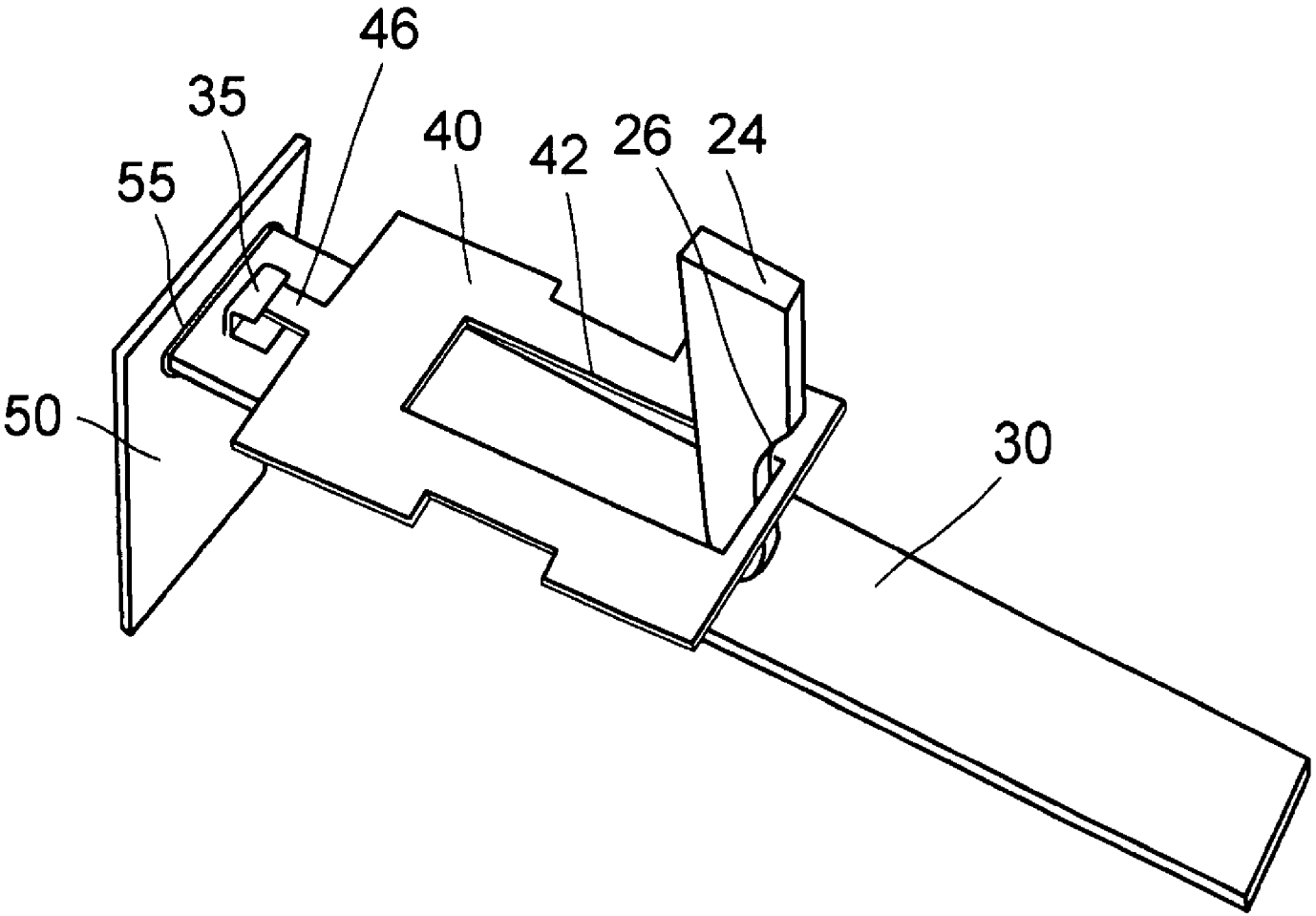
FIG. 6 is a perspective view of a driving blade, a power spring with a locking tab to engage locking tongue of the lock assembly, and a handle rod for pressing down the power spring.

When the locking tongue 46 slides backward, the driving blade 50 is unlocked. In one embodiment, the unlocking of the driving blade 50 is achieved through an opening 42 on the lock shaft 40. The opening 42 is so placed that a rod 24 of the handle 20 can go through the opening 42, and when the handle 20 is pressed down, a rearward facing wedge-like surface 26 on the rod 24 comes into contact with the rear edge of the opening 42, and forces the lock shaft 40 to slide backward, enough to unlock the driving blade 50 when the handle 20 is pressed to a bottom position. In another embodiment, there is a wedge 43 on the lock shaft 40 with a slanted surface on the front side of the wedge 43, for the lock shaft 40 being pushed backward by an additional unlocking rod 28 on the handle 20 as shown in FIG. 5A and FIG. 5B. In this case, one biasing spring 45 is mounted on the back of the lock shaft 40.

As shown in FIG. 4B and FIG. 5B, the locking tongue 46 has a bottom tapered front end 47, so that the driving blade 50 can be pushed up by a return spring 32 to its resting position and being locked.

The return spring 32 is mounted underneath the power spring 30, at a location preferably vertically aligned to the rod 24 of the handle 20. By mounting the return spring 32 vertically aligned to or rearward of the rod 24, the urge of the return spring 32 does not resist the downward movement of the power spring 30 when the driving blade is unlocked. Yet, by mounting the return spring 32 vertically aligned to the rod 24 requires lesser amount of urging force of the return spring to return the power spring to its locked position than by mounting the return spring 32 rearward of the rod 24 does.

At the resting position, power spring 30 and driving blade 50 are reset to locked position by the urging of the return spring 32. During stapling operation, the middle section of the power spring 30 is bent by the handle 20 through the rod 24. With the front end of the power spring 30 being locked by the locking tongue 46, and a rear end of the power spring 30 being supported by a groove 15 of housing body 10, the power spring 30 provides a downward bias upon driving blade 50. When the driving blade 50 is unlocked, the biased power spring 30 will urge the driving blade 50 to move downward, and expels a staple in the front of a staple feeding track 16. The downward motion by power spring 30 is limited by housing body 10, so that driving blade 50 does not extrude from the bottom of housing body 10.

The movement of the rear end of the power spring 30 is confined on three sides, bottom, top and rear (the side way movements are contained by the walls of the housing body 10), by the groove 15, which is a part of the housing body 10. When the middle section of the power spring 30 is pressed down, the front end of the power spring 30 tends to slide backward, but since the power spring 30 is stopped in the rear end by the groove 15, the power spring 30 can not slide out of driving blade openings 55. Upward limitation of the rear end of the power spring 30 by the groove 15 ensures the return spring 32 pushes up only the front end of the power spring 30.

The handle 20 is pivotally attached to the rear end of the housing body 10. A column extension 22 from the rear end of handle 20 inserts into a circular slot formed by walls of housing body 10, serving as a pivot for handle 20. Top panel 12 of the housing body 10 limits the travel of handle 20. It is obvious, that the handle 20 can also be hinged in the front end of the housing body 10, elongated and extends toward the rear of the housing body. Then the stapler becomes rear operated.

Figure 7:
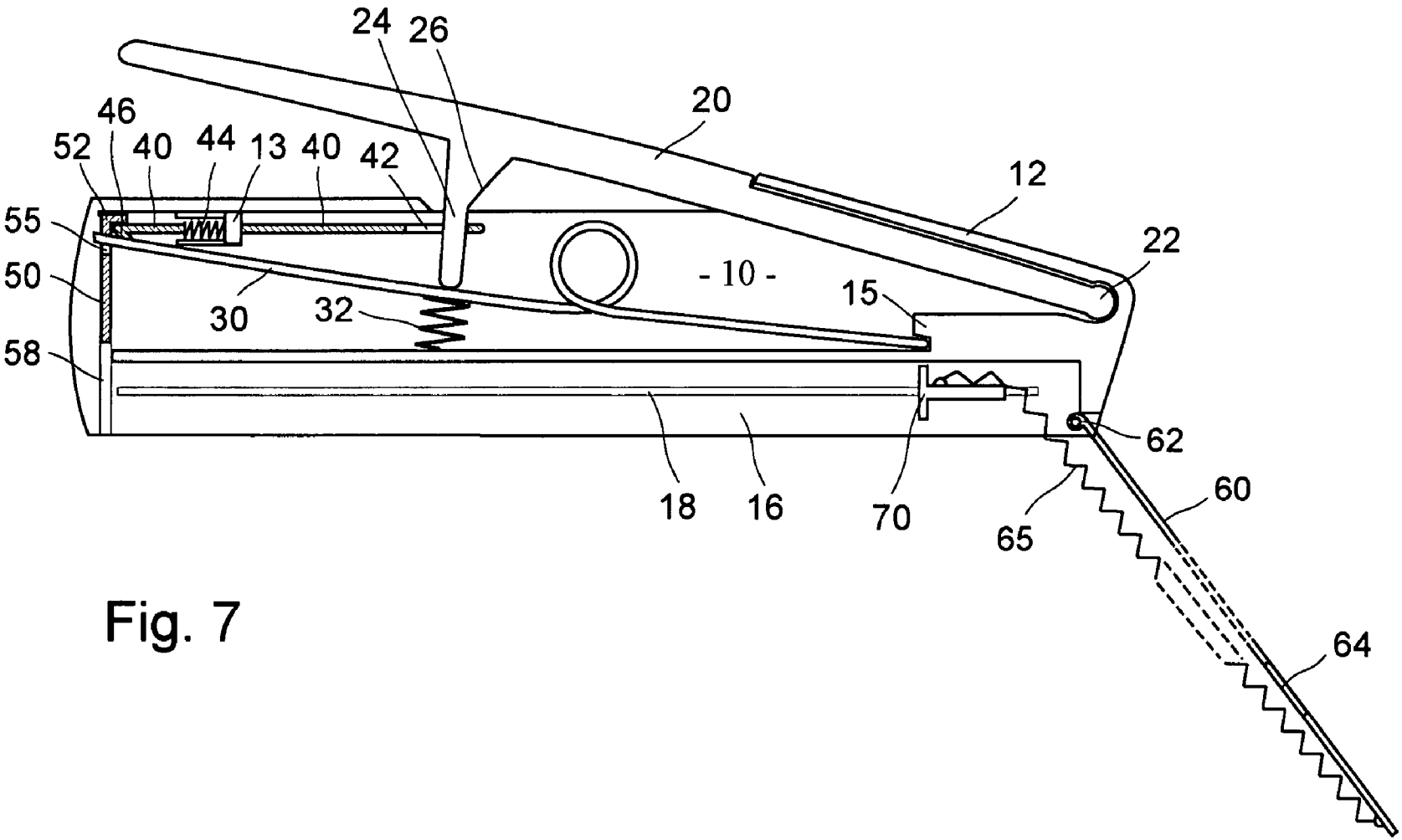
FIG. 7 is a side elevational view of the stapler, shown in a partial sectional view, with the staple retaining panel at an open position.
Figure 9:
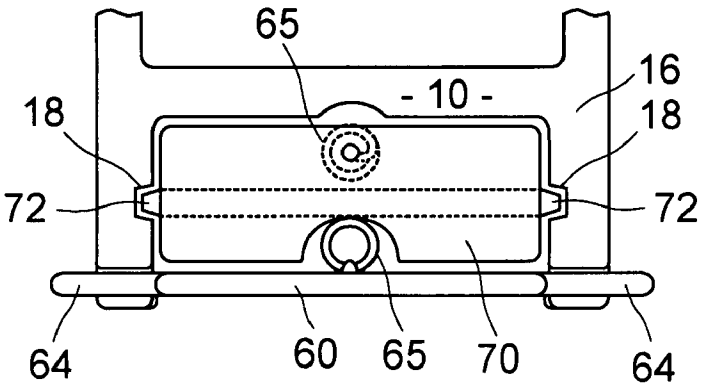
FIG. 9 is a section view of the staple feeding track with a coil spring biased pusher inside.

The feeding track 16 is formed at the bottom of the housing body 10 as shown in FIG. 7. There are guiding slots 18 on both internal sidewalls of the feeding track 16. A slidable pusher 70 has tabs 72 on both sides, the tabs 72 fit in the guiding slot 18 to retain the pusher 70 inside the feeding track 16 as shown in FIG. 9.

Figure 8:
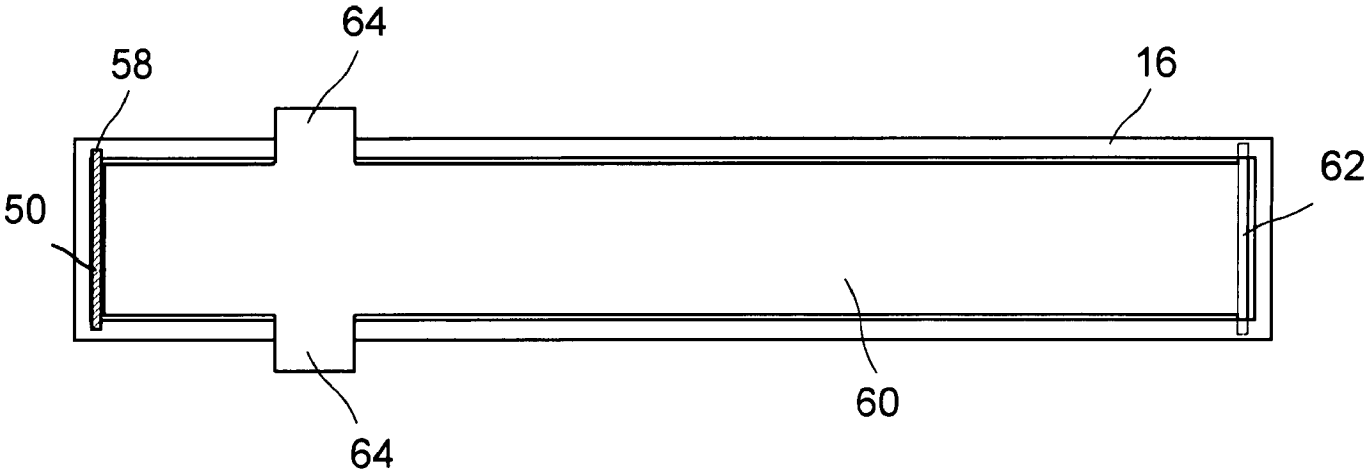
FIG. 8 is a bottom plan view of the stapler with the staple retaining panel snaps to the sidewall of the staple guiding track.
Figure 11:
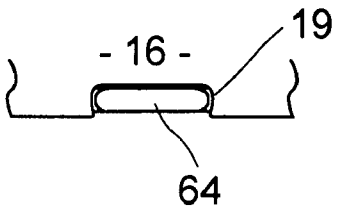
FIG. 11 is a side plan view of a handle of the staple retaining panel accommodated in a notch on the sidewall of the staple feeding track.
Figure 10:
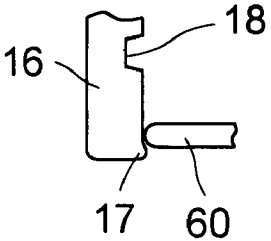
FIG. 10 is a section view of the retaining panel snaps to the sidewall of the staple feeding track.

A retaining panel 60 snaps to the bottom of the feeding track 16 to keep staples inside feeding track 16 during normal operation as shown in FIG. 8. At closing position, there is a gap between a front edge of the retaining panel 60 and a front internal wall of the feeding track 16, the gap forms a staple exit slot to allow expelled staple exit. FIG. 10 shows that the side wall of the feeding track 16 has a protrusive profile 17 near the bottom. FIG. 10 also shows the way how the retaining panel 60 snaps to the sidewall of the feeding track. A rear pin 62 formed on the retaining panel 60 is hinged on the rear end of the sidewalls of the feeding track 16 and serves as a hinge for the retaining panel 60. Handles 64 on both sides of the retaining panel 60 fit into notches 19 formed at the bottom of the sidewalls of the feeding track 16, to serve both as holding places to pull open the retaining panel 60, and to stop the retaining panel 60 from being pushed further into the feeding track 16. The handles 64 optionally snap to the notches 19.

The retaining panel 60 is preferably a thin sheet metal or plastic form, but can also be constructed out of metal wire, as the surface needed to retain staple magazine is only at the two elongated sides of feeding track 16.

A coil spring 65 biases the pusher 70 to push staple(s) forward to the front of the feeding track 16. When the retaining panel 60 being opened, the coil spring 65 drags the pusher 70 to the rear of the feeding track 16 as shown in FIG. 7, exposing the chamber of the feeding track 16 for placing staple magazine.

What is claimed is:

1. A spring-powered stapler comprising:

(a) a housing body having a front and rear end to support and guide functional components;

(b) a staple feeding track formed at the bottom of said housing body having a downward facing opening for loading at least one staple magazine, to store and feed staples toward the front end of said housing body;

(c) a driving blade disposed in said housing body above said feeding track and proximate to the front end of said housing body, and slidably oriented to expel one staple at a time from said feeding track, and having a temporary locked position in an upper end of sliding movement of the driving blade;

(d) a power spring disposed in said housing body, with a front end linked to said driving blade and a rear end confined by a groove in said housing body;

(e) a lock assembly disposed in said housing body, having a slidable lock shaft, at least one biasing spring to urge said lock shaft to slide forward, an edge on said lock shaft far pushing said lock shaft backward, and at least one locking tongue with a bottom tapered front end in a front of said lock shaft to engage said driving blade along with the front end of the power spring in the temporary locked position;

(f) a handle pivotally attached to said housing body at a first location proximate to the rear end of said housing body, having a rod in contact with said power spring at a second location which is forward of said first location and between the front and rear end of the power spring, and said rod also having a wedge-shaped rearward facing surface for pushing said edge of said lock, wherein when said handle is pressed down, said rod presses down the power spring at the second location while the front and rear ends of the power spring still remain in the temporary locked and confined positions, respectively, and pushes said edge on said lock shaft rearward by the wedge-shaped rearward facing surface on the rod for unlocking said driving blade when the handle is pressed further downward to a predetermined location; and (g) a return spring disposed in said housing body with one end linked to the power spring and another end linked to the housing body for urging said power spring and said driving blade upward to the locked position.

2. The spring-powered stapler according to claim 1, wherein said driving blade comprising at least one projective member near a top of said driving blade to engage said locking tongue.

3. The spring-powered stapler according to claim 1, wherein said driving blade comprising at least one opening to engage said locking tongue.

4. The spring-powered stapler according to claim 1, wherein said driving blade comprising at least one opening for linking with said power spring.

5. The spring-powered stapler according to claim 1, wherein said driving blade comprising at least one projective column for linking with said power spring.

6. A spring-powered stapler comprising:

(a) a housing body having a front and rear end to support and guide functional components;

(b) a staple feeding track formed at the bottom of said housing body having a downward facing opening for loading at least one staple magazine, to store and feed staples toward the front end of said housing body;

(c) a driving blade disposed in said housing body above said feeding track and proximate to the front end of said housing body, and slidably oriented to expel one staple at a time from said feeding track, and having a temporary locked position in an upper end of sliding movement of the driving blade;

(d) a power spring disposed in said housing body with a front end linked to said driving blade and elongated and extending from said driving blade toward the rear end of said housing body, and a rear end of said power spring confined by a groove in said housing body, and having a projective locking tab proximate to the front end of said power spring;

(e) a lock assembly disposed in said housing body, comprising a slidable lock shaft, at least one biasing spring to urge said lock shaft to slide forward, an edge on said lock shaft for pushing said lock shaft backward, and at least one locking tongue with a bottom tapered front end in a front of said lock shaft to engage said locking tab of said power spring along with the driving blade in the temporary locked position, (f) a handle pivotally attached to said housing body at a first location proximate to the rear end of said housing body, having a rod in contact with said power spring at a second location which is forward of said first location and between the front and rear end of the power spring, and said rod also having a wedge-shaped rearward-facing surface for pushing said edge of said lock assembly backward to unlock said locking tab of said power spring wherein when said handle is pressed down, said rod presses down the power spring at the second location while the front and rear ends of the power spring still remain in the temporary locked and confined positions, respectively, and pushes said edge on said lock shaft rearward by the wedge-shaped rearward facing surface on the rod for unlocking said locking tab of said power spring when the handle is pressed further downward to a predetermined location; and (g) a return spring disposed in said housing body with one end linked to the power spring and another end linked to the housing body for urging said power spring and said driving blade upward to the locked position.

7. The spring-powered stapler according to claim 6, wherein said driving blade comprising at least one opening for linking with said power spring.

8. The spring-powered stapler according to claim 6, wherein said driving blade comprising at least one projective column for linking with said power spring.

9. The spring-powered stapler according the claim 6, wherein said return spring is disposed underneath said power spring.

* * * * *